US007896155B2

(12) United States Patent
Seelhofer

(10) Patent No.: US 7,896,155 B2
(45) Date of Patent: Mar. 1, 2011

(54) CAPSULE CLOSURE

(75) Inventor: Fritz Seelhofer, Lindau (CH)

(73) Assignee: Belcap AG, Neuhausen Am Rheinfall (CH)

( * ) Notice: Subject to any disclaimer, the term of this patent is extended or adjusted under 35 U.S.C. 154(b) by 531 days.

(21) Appl. No.: 11/664,050

(22) PCT Filed: Sep. 28, 2005

(86) PCT No.: PCT/CH2005/000558

§ 371 (c)(1),
(2), (4) Date: Jan. 25, 2008

(87) PCT Pub. No.: WO2006/037244

PCT Pub. Date: Apr. 13, 2006

(65) Prior Publication Data

US 2008/0290061 A1 Nov. 27, 2008

(30) Foreign Application Priority Data

Oct. 1, 2004 (CH) ..... 1599/04

(51) Int. Cl.
*B65D 25/08* (2006.01)

(52) U.S. Cl. ..... 206/222; 206/219; 215/DIG. 8

(58) Field of Classification Search ..... 206/219, 206/220, 222, 454, 448, 447, 145, 548; 222/521, 222/525, 83.5, 548, 541.2; 220/277, 278
See application file for complete search history.

(56) References Cited

U.S. PATENT DOCUMENTS 2,569,666 A * 10/1951 Granatek ..... 540/314
3,802,604 A * 4/1974 Morane et al. ..... 222/83
6,435,341 B1 * 8/2002 Nobbio ..... 206/219

* cited by examiner

*Primary Examiner*—J. Gregory Pickett
*Assistant Examiner*—Raven Collins
(74) *Attorney, Agent, or Firm*—Yi Li

(57) ABSTRACT

The invention relates to a capsule closure, the cap of which comprises a receptacle (2) that is formed on the interior of the lid and that fits into the interior of a corresponding nipple part (3). An associated film-sealed container capsule (8) can be locked into the interior of the receptacle (2), with the film facing downwards (9), so that the sealing film (9) lies against the inner diameter of the cap (1). A circular shoulder that projects inwards (10) is configured in the interior of the nipple part (3) below the inserted container capsule (8). Several fixed and/or displaceable piercing and/or cutting elements (12) are formed on the inner edge (11) of said shoulder (10). A tamper-evident strip (15) is supported on a shoulder (17) that projects radially outwards below the lower cap edge of the attached cap (1). Once said strip has been removed, the cap (1) can be pushed down onto the nipple part (3), causing the piercing and/or cutting elements (12) to cut open the film (9). The section (14) of the nipple part (3) that lies below the shoulder (10) can be configured as a collar or flange.

9 Claims, 7 Drawing Sheets

CAPSULE CLOSURE

Figure 1:
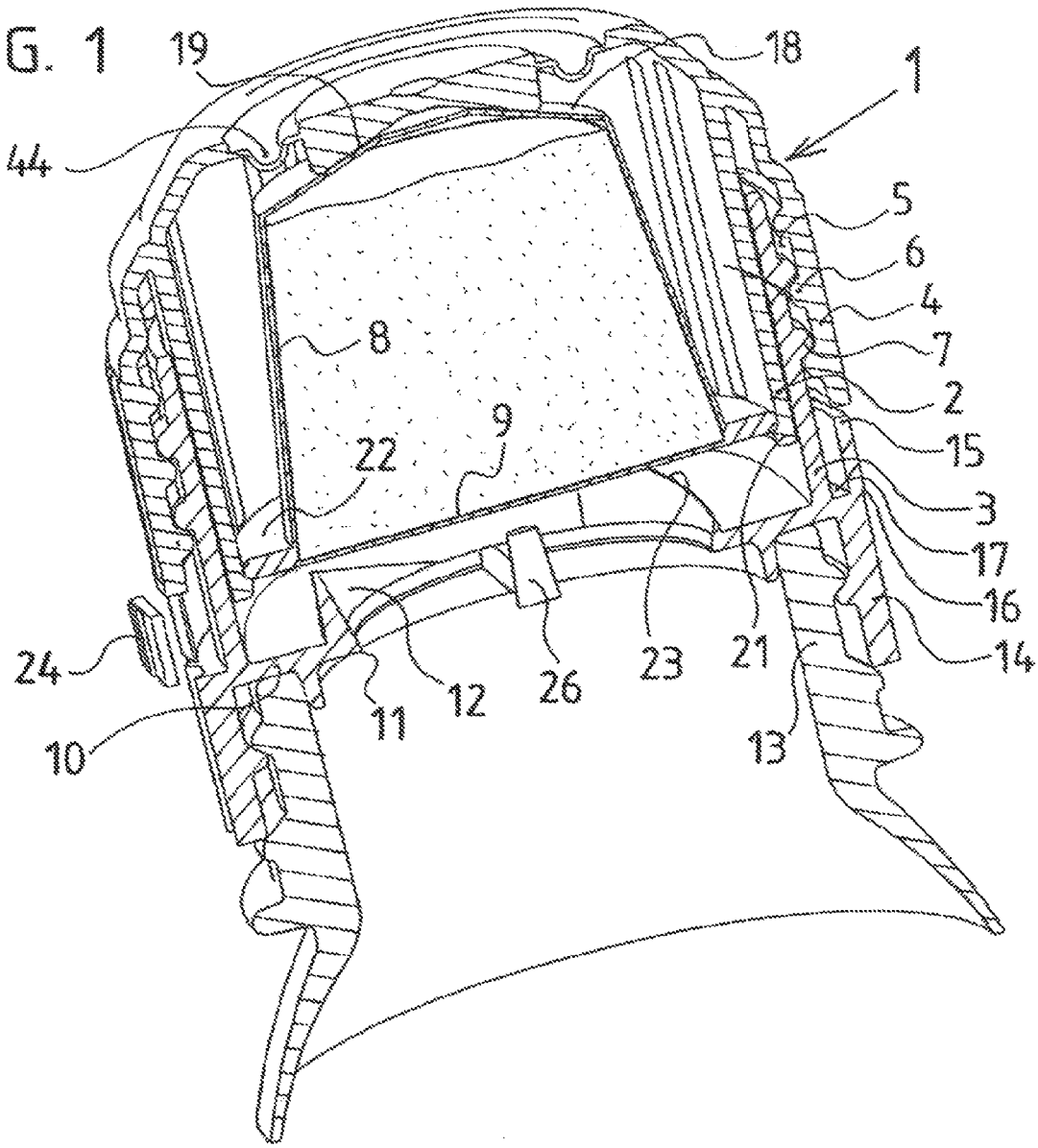

The present invention relates to a capsule closure, i.e. a cap closure with a receiving capsule for mounting over the spout or on to the threaded connector end of a container for liquids or bulk material. The capsule closure enables metering a substance by activating the cap, that is to say by pressing it down or by unscrewing it.

This capsule closure can be mounted on a variety of containers, for example on all types of bottles made of glass or plastic or on to similar containers. Further, the closure can also be configured for threaded connector ends of bottles or containers of all types which may optionally be sealed with a film material. Alternatively, the capsule closure is also suitable for a variety of containers for liquid or bulk material. Specifically this means packaging in the form of combipacks made of film-coated paper for packaging, for example, milk, fruit juices, all types of non-alcoholic beverages or liquids in general of a non-food type. The closure can also be used for combipacks for storing or packing dry bulk goods such as sugar, semolina or all types of chemicals, medicaments, for example in the form of pills and similar. This film coated paper is a laminate, for example a paper or cardboard web coated with a plastic such as polyethylene and/or aluminium. Usual volumes of such packings range from 20 cl to up to 2 liters and more.

There are a variety of examples in which an active agent in the form of a liquid substance or in the form of free flowing bulk material must be added or dosed to a liquid or a powder or another type of free flowing bulk material before use. For reasons of perishability, this active agent or substance cannot be added to the liquid or to the bulk material from the outset. In fact, the substance must be stored separately and be hermetically sealed in order to prevent contact with oxygen. Thus, there a number of vitamins which are bound in fizzy tablets and which are dissolved in a drink or in water immediately prior to intake. Also all types of medicaments such as headache pills are dissolved in water immediately prior to use. Also, a small portion of a high percentage alcohol could also be contained in such type of receptor device which, when the closure is opened, is added into a soft drink or fruit drink to obtain a so-called alcopop-drink having an alcohol content of around 5 Vol-%, In such cases where a substance must be metered, admixed or dissolved in a fluid, those substances which must be hermetically stored and dissolved prior to use or mixed with a further substance have to be separately packaged and stored. They are only unpacked and added to a fluid or to a further substance immediately prior to use. This is complicated and requires a number of manipulations. Furthermore, often only the agent is available but no resolvent. For example, en route one has the headache pill but no water to dissolve it in.

It is therefore the object of the present invention to provide a capsule closure which, when opened for the first time, automatically releases an active component out of a separate capsule which is provided with a gas and liquid proof hermetic barrier. Thus, it may be necessary to fabricate the entire capsule out of such a barrier-type material. It must be possible to configure this capsule closure as a threaded cap closure as well as a sliding or snap-on cap closure, and—depending upon the configuration—it should be mountable on the threaded connector end of a container or a bottle, or, when provided with a flange, should be mountable over the spout of any type of container by bonding or welding, for example to the spout opening of a combipack container or of a metal or plastic container. It should permit metering a separate liquid substance into a liquid or into a powder, into granulate or free flowing bulk material, or, reversely, should permit metering free flowing bulk material or a powder into a liquid or into a powder, a granulate or another type of free flowing bulk material.

This object is achieved by a capsule closure for mounting over the spout opening or onto the threaded connector end of a liquid or dry goods container for metered addition of a substance by pressing down or by unscrewing the cap; the cap has a receptor device formed at its lid inner side, which fits into the interior of a coordinated or dedicated nipple part; further, a coordinated or dedicated film-sealed container capsule having sealing film can be latchingly engaged in the interior of the receptor device, with the sealing film facing the lower side of the cap; in the interior of the nipple part, below the inserted container capsule, there is an annular shoulder which projects radially inwards, at the inner edge of which there is moulded at least one fixed or movable piercing and/or cutting element; and on a shoulder which projects radially outwards, there is supported a tamper-evident strip below the lower cap edge of the attached cap; after removal of the tamper-evident strip the cap can be pushed down on to the nipple part, causing the fixed or movable piercing and/or cutting element to become effective and cut the film; the section of the nipple part that lies below the shoulder can be configured as a sleeve or flange.

The Figures show various aspects of preferred embodiments of this capsule closure for mounting over the spout opening or on to the threaded connector end of a liquid or bulk material container for metered addition of a substance. These capsule closures are more closely described and their function shall be exemplified and explained by means of these Figures.

Figure 3:
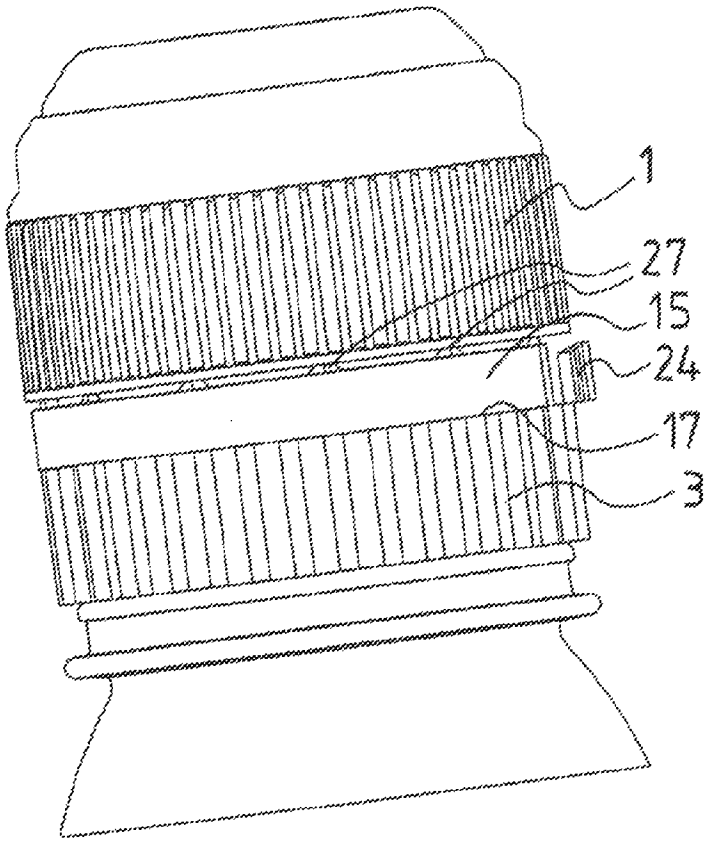
Figure 2:
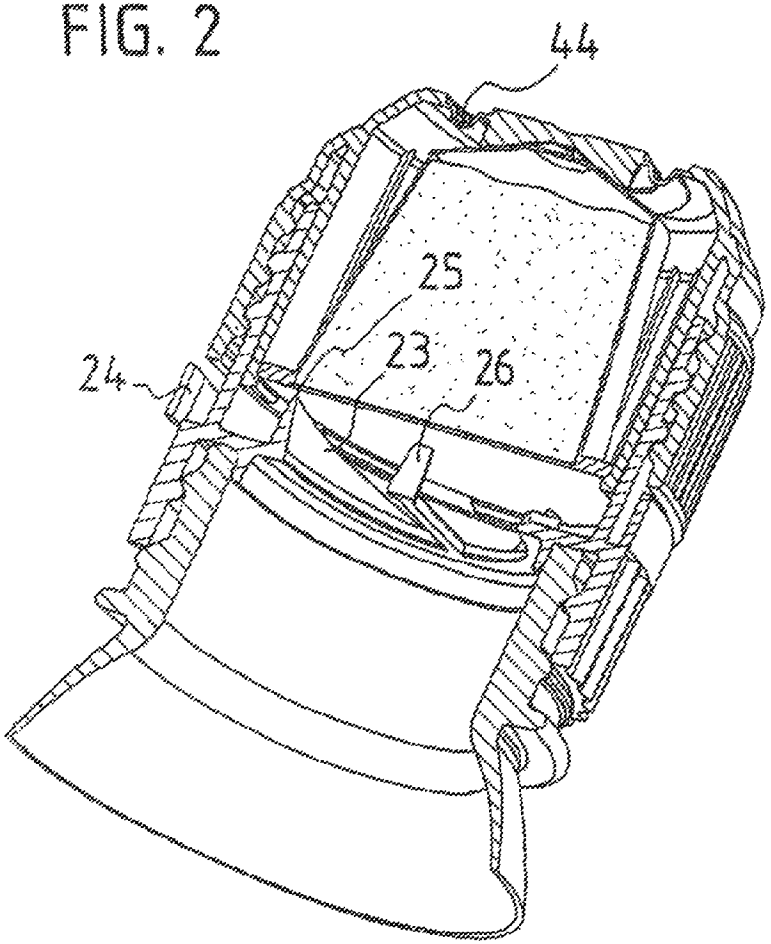
Figure 5:
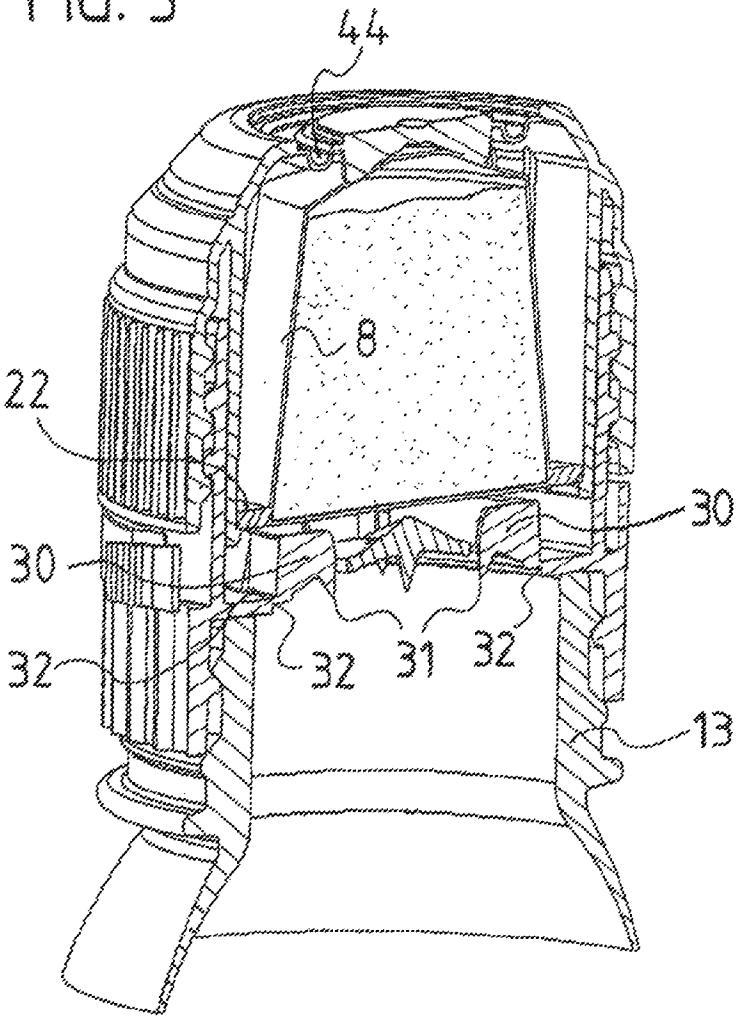
Figure 4:
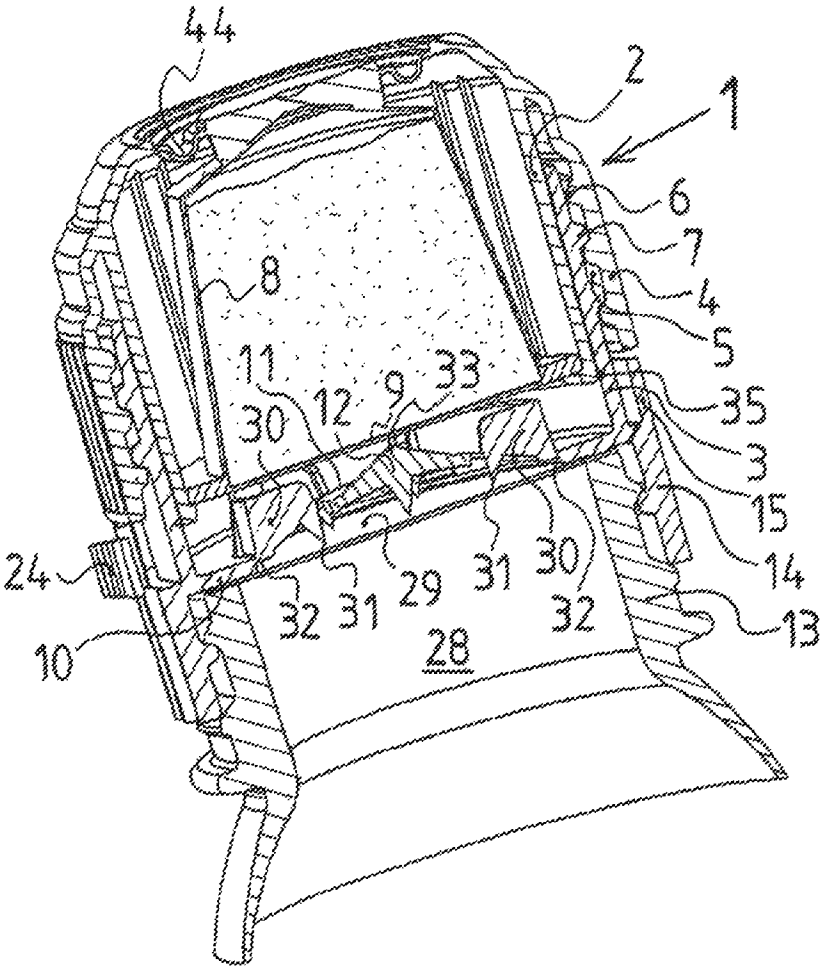
Figure 7:
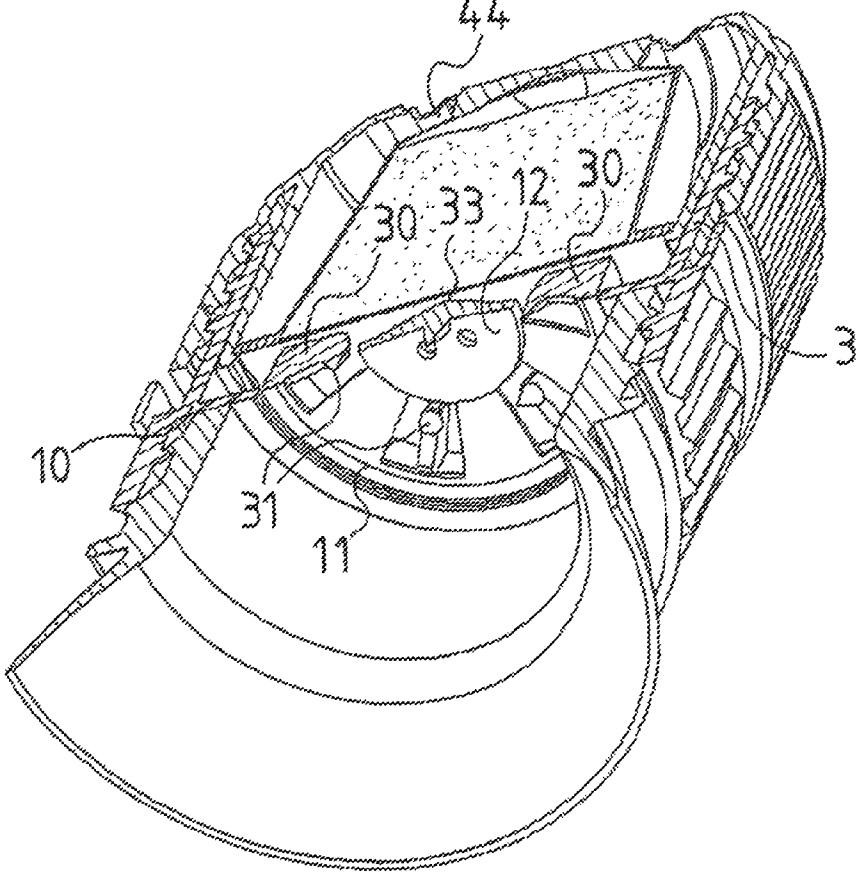
Figure 6:
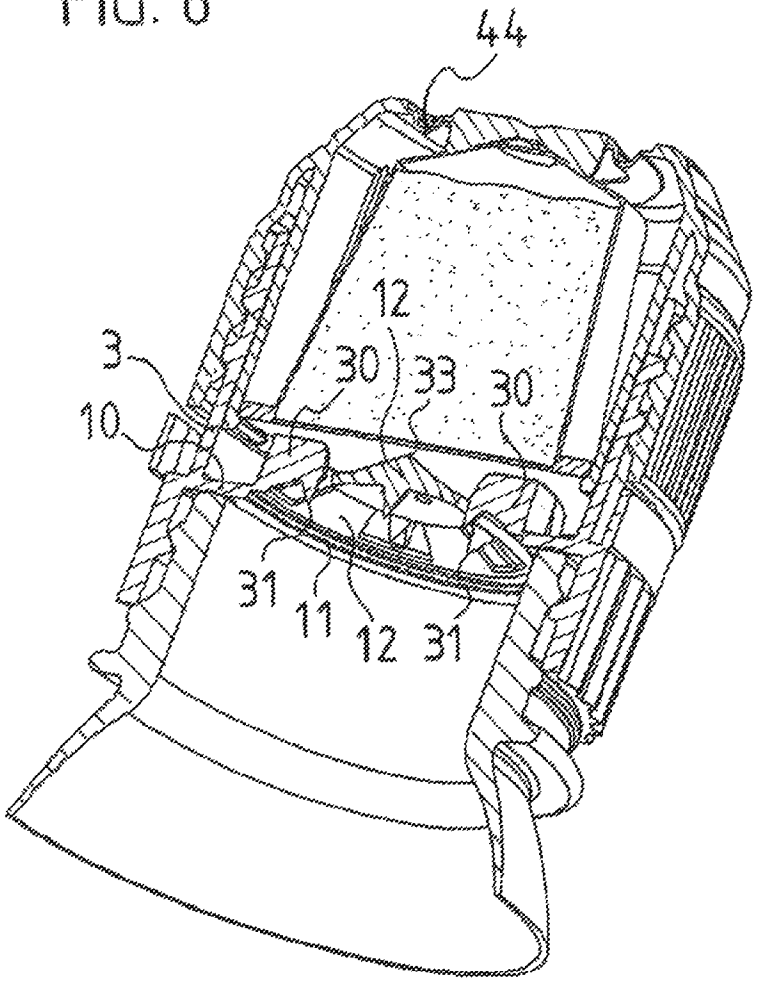
Figure 9:
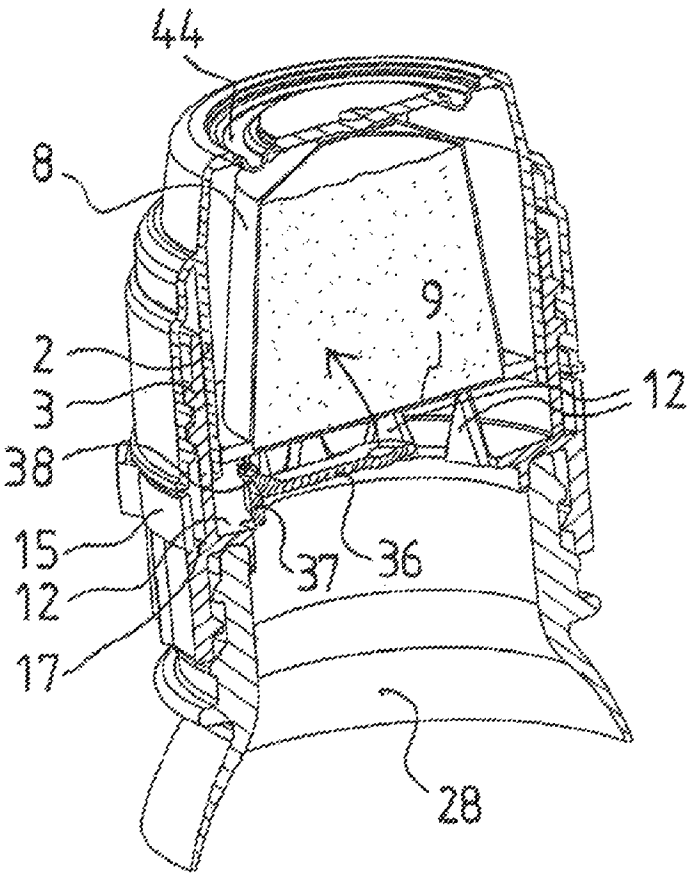
Figure 8:
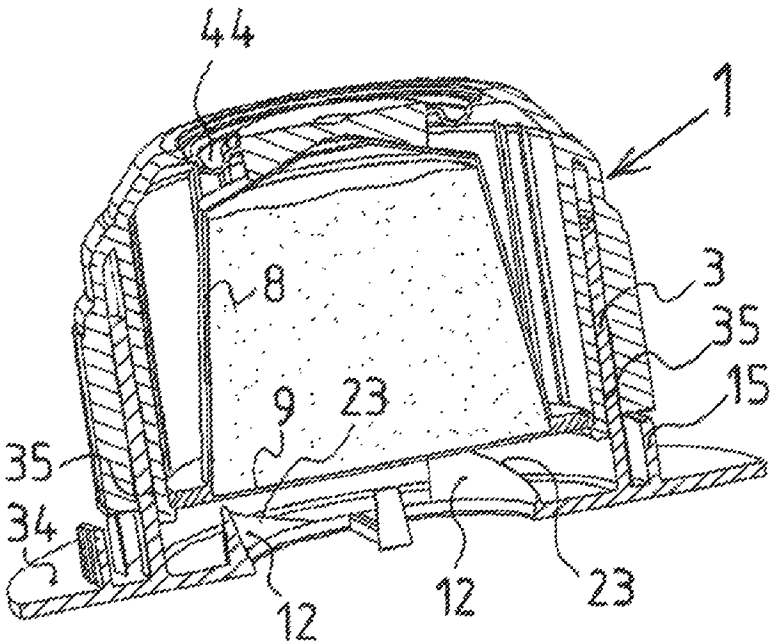
Figure 11:
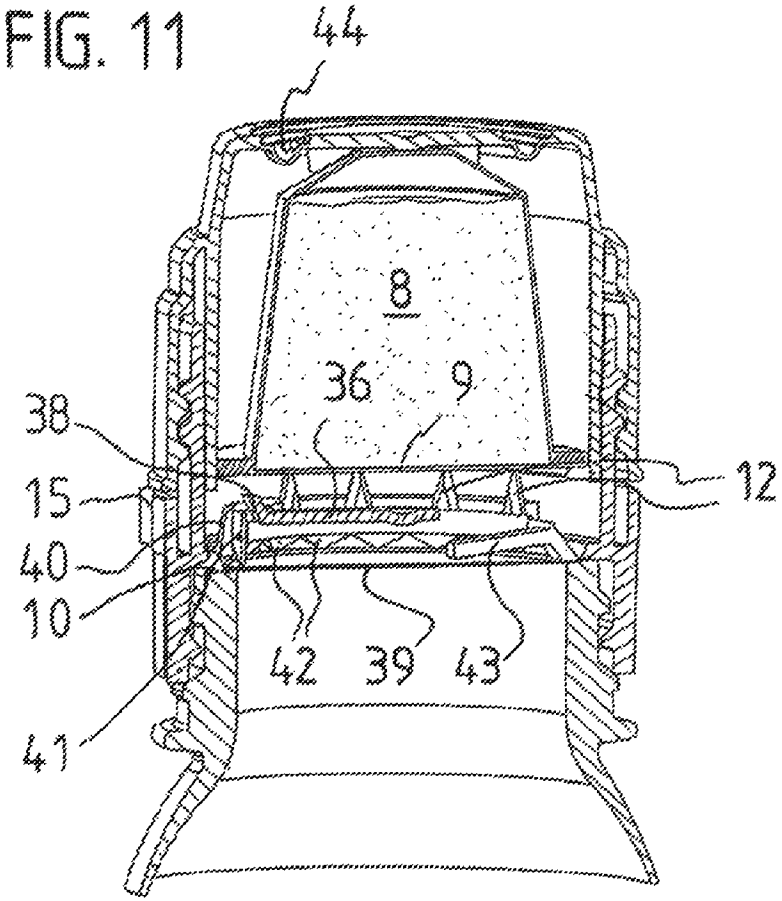
Figure 10:
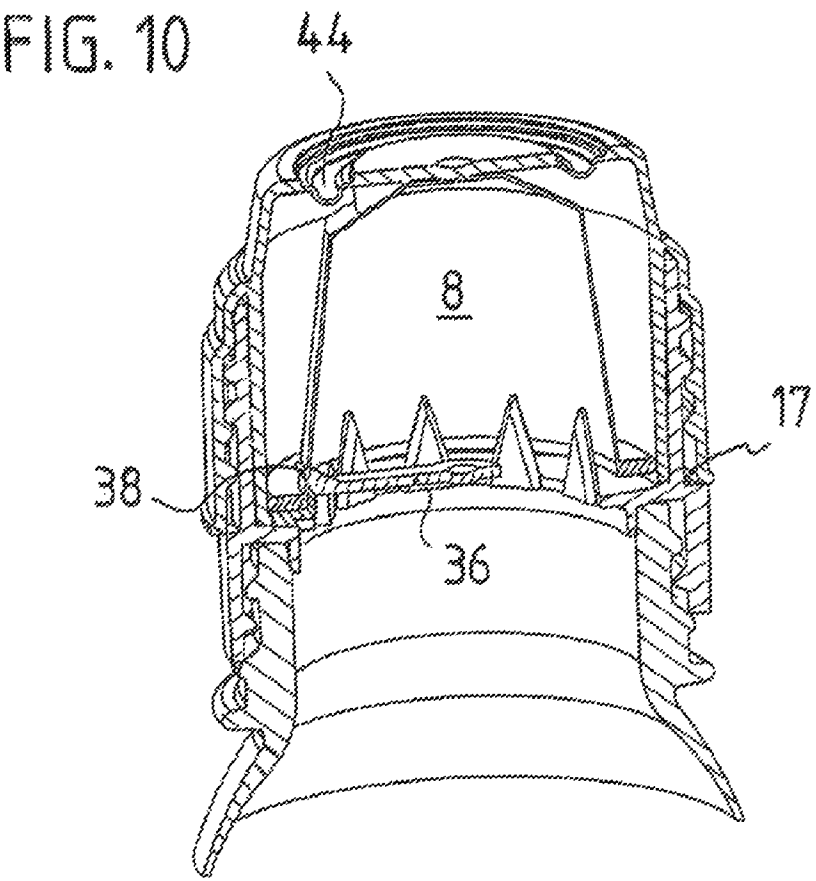
Figure 12:
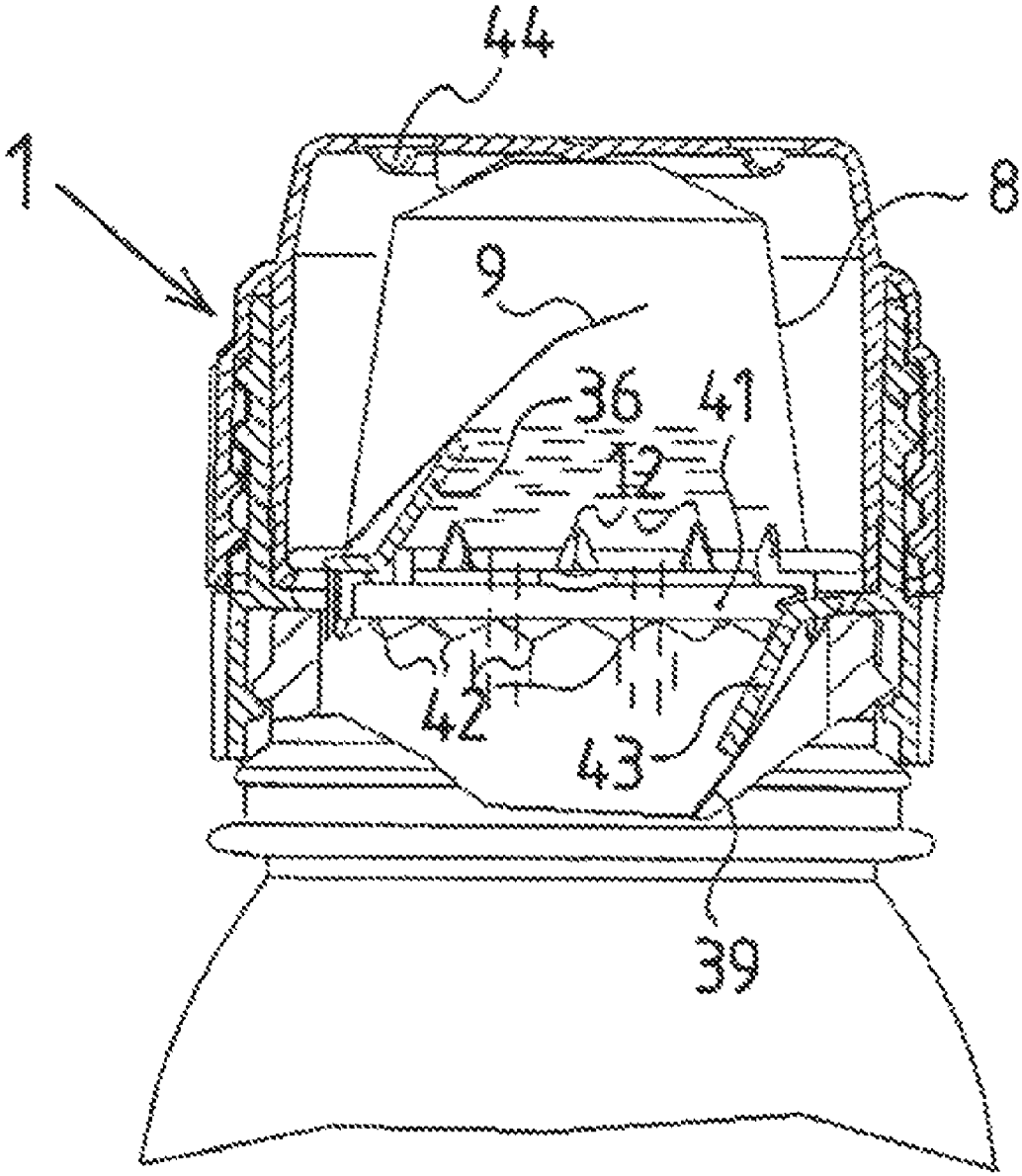

It is shown:

FIG. 1 A capsule closure configured as a threaded cap closure having a container capsule therein and screwed on to a threaded connector end, in a sectional view along the rotational axis of the closure;

FIG. 2 The capsule closure of FIG. 1 screwed on to a threaded connector end, in a sectional view along the rotational axis of the closure, seen in perspective from a slantwise view from below;

FIG. 3 The capsule closure of FIG. 1 or 2 in a lateral view;

FIG. 4 A capsule closure configured as a threaded cap closure having a container capsule therein, in a sectional view along the rotational axis of the closure, screwed onto a threaded connector end sealed with its own film;

FIG. 5 The capsule closure of FIG. 4 in a sectional view along the rotational axis of the closure, seen in perspective from a slantwise view from above, screwed on to a threaded connector end which can be sealed with a film;

FIG. 6 A capsule closure configured as a threaded cap closure having a container capsule therein, in a sectional view along the rotational axis of the closure, seen from a slantwise view from below, screwed on to a threaded connector end which can be sealed with a film;

FIG. 7 The capsule closure of FIG. 6 in another view from approximately underneath;

FIG. 8 A capsule closure configured as a sliding cap closure having a container capsule therein, in a section taken along the rotational axis of the closure, for bonding on to a combipack;

FIG. 9 A capsule closure in an alternative embodiment, in a perspective longitudinal section prior to opening;

FIG. 10 The capsule closure of FIG. 9 in a perspective longitudinal section after opening;

FIG. 11 A capsule closure having a double-side-effective piercing and cutting element for opening a double film seal, in a perspective longitudinal section prior to opening;

FIG. 12 The capsule closure of FIG. 11 in a longitudinal section after opening.

FIG. 1 shows a first embodiment of the capsule closure. Here it is configured as a threaded cap closure, in that the cap 1 forms a threaded cap. On its lid inner side there is formed a receptor device 2 which is arranged concentrically to the cap 1, which receptor device 2 fits into a coordinated or dedicated nipple part 3. The nipple part 3 is a separate injection-molded part. The outer wall 4 of the threaded cap 1 has on its inner side 5 a thread 6, which fits on to the outer thread 7 of this nipple part 3. This is a left-handed thread. That means, that when turning the cap 1 seen from above in a counter-clockwise direction, it is screwed downwards on to the nipple part 3. Below the lower edge of the threaded cap 1 there is a tamper-evident strip 15, which here is attached to the nipple part 3 by means of a dedicated tearing point 16 and which can be gripped at the ear 24. After removing this tamper-evident strip 15, the threaded cap 1 at the nipple part 3 is screwable downwards by a left-hand rotation, until the lower edge of the threaded cap 1 abuts at the outer shoulder 17 at the nipple part 3. In the interior of the receptor device 2 there is provided a container capsule 8. This can be made in one piece with the cap 1, or can be made, filled and sealed individually in a separate process. If necessary, the entire capsule can consist of a gas and liquid proof barrier material, for example EVOH, polyamide, aluminium, or composite or laminate materials therefrom. In the embodiment shown, this container capsule 8 consists of a deep-drawn or injection molded container whose opening is sealed with a film 9 having at least one layer. This film 9 is bonded on to the container or the container capsule 8 only after this has been filled with content, for example with a certain active substance. Here, the container capsule 8 has the shape of a cone section and is overturned, i.e. is inserted into the receptor device 2 of the cap 1 with its sealing film 9 on the underside. In the example shown, the base 18 of the inserted container capsule, here at the top because of the overturned insertion, forms an obtuse angled cone 18. With this obtuse angled cone 18, the container capsule 8 fits at least into a conically tapering support element 19 at the underside of a pressure element 20, which pressure element 20 forms a part of the cap lid and is surrounded or enclosed by a circumferential, deformable thin place or part 44. That is why, by deforming the thin part 44, the pressure element can be pressed axially downwards at the cap 1 so as to push the container capsule out of the cap 1 after unscrewing this cap 1. A slightly projecting bead 21 extends along a part or along the entire circumference of the inner side of the lower edge of the receptor device. When the container capsule 8 is pushed base first into the receptor device, its radially projecting edge 22 latchingly engages behind this bead 21, so that the container capsule 8 is held down slightly under tension between the support element 19 and this bead 21. At the same time this ensures that it cannot be turned out of position, i.e. is untwistable, in the receptor device 2. Additionally, the container capsule's projecting edge 22 can be provided with motion-engaging cams which engage into suitable depressions in the receptor device 2, so that the security against displacement is increased. Conversely, depressions can be arranged at the projecting edge 22 and the receptor device can be provided with suitably fitting ridges. As can be seen, at the nipple part 3 below the lower edge of the threaded cap 1, at the level of the lower edge of the tamper-evident strip 15, there is formed an annular shoulder 10 projecting radially inwards. At the inner edge of this annular shoulder 10, three piercing and/or cutting elements 12 are arranged distributed around the circumference, of which only two can be seen in the sectional drawing. The cutting edges 23 of these piercing and/or cutting elements 12 are arranged at a slanting angle to the rotational plane of the cap and direct upwards. In radial extension to the annular shoulder 10, an outwardly projecting shoulder 17 extends at the nipple part 3, to which shoulder the tamper-evident strip 15 is fastened by the dedicated tearing point 16. The tamper-evident strip 15 may equally well be fastened by the dedicated tearing point or by several discrete dedicated breaking points at the lower edge of the threaded cap 1. Below the tamper-evident strip 15 the nipple part 3 extends for a slight distance in axial direction downwards and thus forms a threaded sleeve 14. This sleeve 14 enables the whole closure to be screwed onto the threaded connector end 13 of a container, specifically onto the threaded connector end of a bottle.

The closure works as follows: In the container capsule 8, and hermetically sealed off by the film 9, there is an agent in the form of a liquid substance or a freely flowing bulk material (shown by dots in the container capsule 8 in FIGS. 1-2, 4-9 and 11, and shown by broken lines in FIG. 12). When the bottle with the capsule closure, to whose content the agent is to be meteringly added, is opened for the first time, the tamper-evident strip 15 must first be removed. Thereafter, the threaded cap 1, which is tightly screwed on to the threaded connector end 13 of the bottle, can be screwed downwards on the outer thread 7 of the nipple part 3. For this, the threaded cap 1 is turned towards the left, i.e. when seen from above in counter-clockwise direction. Due to the left-handedness of the thread the threaded cap 1 is displaced downwards. The container capsule 8 is turned with the threaded cap 1 because it is retained inside the threaded cap so as not to turn out of position. Accordingly, the film 9 is lowered and twisted over the piercing and/or cutting elements 12. As a result they cut the film 9 with their cutting edges 23, whereupon the active substance in the container capsule 8 flows, trickles or falls into the inside of the bottle or the container. As soon as the lower edge of the threaded cap 1 abuts at the outer shoulder 17 of the nipple part 3, this is turned with the further rotation of the threaded cap 1 and is thus screwed off the threaded connector end 13 of the bottle or the container. Thus the cap closure is completely removed from the bottle or the container. Thereafter the contents of the bottle or the container can be poured out.

Instead of providing a left-handed thread between the threaded cap 1 and the nipple part 3 it is possible to use a right-handed thread. In this case, after removal of the tamper-evident strip 15 the threaded cap 1 is first turned in a clockwise direction until the lower edge of the threaded cap 1 abuts at the outer shoulder 17 of the nipple part 3. Thereby the container capsule 8 is displaced downwards in the same manner and is twisted over the piercing and/or cutting elements 12, so that their cutting edges 23 cut open the film and the contents of the container capsule 8 fall into the container or bottle. Thereafter the threaded cap 1 is unscrewed in counter-clockwise direction from the nipple part 3 and the exposed nipple part 3 thus forms the spout neck of the bottle or the container.

FIG. 2 shows this cap closure according to FIG. 1 in a section along the rotational axis of the closure in perspective seen in a slantwise view from below. Here one sees the configuration of the piercing and/or cutting elements 12 with their cutting edges 23 at a slanted angle to the rotation plane. When the threaded cap 1 is rotated downwards in a counter-clockwise direction viewed from above, the tips 25 first pierce the film 9 at three points about the circumference, and by further rotating the threaded cap 1 downwards the cutting edges 23 then cut clean incisions in the film 9 along the circumference of the capsule opening, so that the contents of the capsule reliably flow or fall into the interior of the bottle or the container. The central stabilizing thorn 26 helps to maintain the tautness of the film 9 whilst it is being cut along its periphery. In this example, the thread between the nipple part 3 and the threaded cap 1 is a right-handed thread, because the lower part of the nipple part 3 has merely impacted on the bottle neck and therefore cannot be screwed off. In order to open the closure it is therefore necessary to unscrew the threaded cap 1 without removing the nipple part. Therefore, in order to open the closure, the tamper-evident strip 15 is first gripped at the ear 24 and is torn away. Then the threaded cap 1 is rotated in a clockwise direction when viewed from above, which results in it being screwed downwards on the nipple part 3, resulting in the film 9 of the container capsule 8 being cut open. After the threaded cap 1 has been screwed downwards so as to abut at the outer shoulder of the nipple part 3, it is unscrewed from the nipple part 3 in the opposite direction, that means in a counter-clockwise direction when viewed from above, and is entirely removed therefrom, whereby the bottle or the container is ready to be emptied.

FIG. 3 shows such a capsule closure according to FIG. 1 or 2 in a lateral view. As can be seen from this Figure, the tamper-evident strip 15 is connected to the threaded cap 1 in one piece by means of a number of dedicated breaking points 27, whilst its lower edge rests on the outer shoulder 17 of the nipple part 3. An ear 24 is attached to the tamper-evident strip 15, which can be gripped and by breaking the dedicated breaking points 27 this strip can be torn away from the threaded cap 1.

FIG. 4 shows a capsule closure configured as a threaded cap closure containing a container capsule 8 viewed in a section along the rotational axis of the closure. Here the closure is screwed on to a threaded connector end 13 which is sealed with a film 29. When this threaded cap closure with its container capsule 8, which is film-sealed for an active agent, is applied to such a container with its own film-sealed threaded connector end 13, then two films must be opened; namely firstly the film 9 of the container capsule 8 having the active agent, and secondly the film 29 on the connector end 13 of the bottle 28 or of the container. This is enabled by the threaded cap closure shown here, in that it comprises not only piercing and/or cutting elements having upwardly directed cutting edges, but also elements having downwardly directed piercing and/or cutting edges. The piercing and/or cutting element 12 for opening the film 9 of the container capsule 8 here comprises an arch which is supported laterally at the edge 11 of the projecting annular shoulder 10, and forming a piercing tip 33 on its upper side. The further piercing and/or cutting elements 30 at the inner edge 11 of the annular, inwardly projecting shoulder 10 of the nipple part 3 are movable, i.e. are downwardly pivotable around the shoulder edge 11. They comprise downwardly directed piercing tips 31. This capsule closure works as follows. Firstly, the tamper-evident strip 15 is torn away. Then the threaded cap 1 can be screwed downwards, whereby the stationary piercing and/or cutting element 12 with its upwardly directed piercing tip 33 opens the film 9 at the container capsule 8. At the same time, pressing down on the container capsule causes the piercing and/or cutting elements 30 to be pivoted downwards. Each of these piercing and/or cutting elements 30 is pivotably formed on to the inner edge 11 of the radial inwardly projecting shoulder 10 at the nipple part 3 by means of a dedicated thin part 32. By downwardly pivoting these piercing and/or cutting elements 30, their piercing tips 31 are pressed through the film 29 and open it. Thereby the contents of the container capsule 8 arrive in the inside of the bottle or the container and then the threaded cap 1 can be completely screwed away.

FIG. 5 shows the embodiment of the cap closure according to FIG. 5 in a section along the rotational axis of the closure, seen in perspective at a slanted angle from above and screwed on to a threaded connector end 13 to be sealed with a film. Here one sees the thin parts 32, about which the piercing and/or cutting elements 30 with their piercing tips 31 are downwardly pivotable when they are pushed downwards by the projecting edge 22 of the container capsule 8.

FIG. 6 shows this cap closure seen from a slantwise view from below. One sees the piercing and/or cutting element 12 which is configured as an arch over the free opening within the radially inwardly projecting shoulder 10 at the nipple part 3, with the piercing tip 33 formed at the upper side of the arch. The arch is not totally supported about its complete circumference at the edge 11, but has gaps in which the downwardly pivotable piercing and/or cutting elements 30 with their downwardly projecting piercing tips 31 are arranged. In order to show this more clearly, the cap closure in FIG. 7 is seen in a view from approximately underneath.

Finally, FIG. 8 shows an embodiment of such a cap closure as a sliding cap closure with a container capsule 8 accommodated therein, in a section taken along the rotational axis of the closure. In this embodiment, the closure can be bonded on to a combipack. In contrast to the previously described embodiment, here the cap does not have a thread, neither a left- nor a right-handed one, but is simply slid over the nipple part 3 which has a smooth exterior. The cap 1 having a smooth inner side fits tightly on to the nipple part 3, and an additional seal or gasket can be inserted between the cap 1 and the nipple part 3, or can be blow-injected in the form of a lip 35. The underside of the nipple part 3 is configured as a flange 34. By means of this flange the cap closure can be welded or bonded on to the spout opening of a container made of plastic or metal. The function of the cap closure remains unchanged. After removing the tamper-evident strip 15, the sliding cap 1 can be depressed, whereby the piercing and/or cutting elements 12 cut open the film 9 on the container capsule 8 with their upwardly directed cutting edges 23. In addition, the cap 1 can then be rotated about 120° or more so that the film 9 is completely cut away. The contents of the container capsule 8 then fall into the inside of the container and its contents are thus ready for use. The cap 1 is pulled away upwardly and the contents of the container can be emptied.

In FIG. 9 an alternative embodiment of this cap closure is shown, here by means of a perspective longitudinal section. One recognizes the container capsule 8 in the receptor device 2. At the inner side of the inwardly projecting shoulder 12 there are formed upwardly directed piercing and cutting elements 12. At the edge of the inwardly projecting shoulder 10 a pretensioning lever 36 is attached to a support element 37, so that the lever is pivotable about the support element vertically, i.e. is pivotable about a horizontally lying axis. If, after tearing away the tamper-evident strip, the cap 1 is screwed in an unfastening direction, then it moves in axial direction downwards and presses the container capsule 8 with its outer edge on to the rearward lever 38 of the pretensioning lever 36. The lever 38 thus moves downwards, as shown with the small arrow, and the pretensioning lever 36 is pivoted upwards, as shown with the longer arrow. Thereby the end of the pretensioning lever 36 presses on to the film 9 of the container capsule 8 and tensions it. At the same time the tips of the piercing and cutting elements 12 pierce the film at its periphery and then cut out the film roundly with the exception of that part where the pretensioning lever 36 is attached. The cut away film is retained upwards by the pretenstioning lever 36 and the contents of the container capsule fall into the bottle. If the cap 1 is further turned in a loosening direction, then it is unscrewed from the bottle neck and can be removed. In this example the thread between the nipple part 3 and the threaded cap 1 is a right-handed thread. Therefore, when the cap is turned from its initial position in a counter-clockwise direction, as seen from above, it moves towards the bottle and thereby opens the container capsule 8 as described, until its lower edge comes up against the outwardly projecting shoulder. From that point on it takes the lower part with it in a counter-clockwise direction and screws it away from the bottle thread.

FIG. 10 shows this cap closure in an opened state of the container capsule 8. The teeth of the piercing and cutting elements 12 project upwards into the interior of the now downwardly pressed capsule 8. The lower cap edge now lies upon the outwardly projecting shoulder 17.

In FIG. 11 a particularly sophisticated version of this cap closure is illustrated. It comprises a double-side-effective piercing and cutting element 12 for opening a double film seal. This is sensible in those cases when the container capsule 8 may not be bathed in the liquid contained in the bottle. That would otherwise be the case if the bottle is tipped. That is why the mouthpiece of the bottle neck is itself sealed with a separate sealing film 39. The inwardly projecting shoulder 10 here evolves into a flexible, supple wall 40 which surrounds a ring wall 41, which carries downwardly directed piercing and cutting members 42 at its lower edge. On one side of the ring wall 41 there is formed a slanted pretensioning lever 43 which extends from the ring wall towards the centre of the spout. The upwardly directed piercing and cutting elements 12 and the pretensioning lever are attached at the upper edge of the ring wall 41. When the cap 1 is rotated from its initial position in a loosening direction after removal of the tamper-evident strip 15, then the container capsule 8 is pressed downwards and the teeth of the piercing and cutting elements 12 pierce the film 9. Then the edge of the container capsule 8 presses on to the lever 38 of the pretensioning lever 36, which is subsequently pivoted upwards, so that it presses on to the film 9 and pretensions this. This facilitates cutting the film cleanly up to the region where the pretensioning lever 36 is attached. If the cap 1 is turned further, then the edge of the container capsule 8 presses on to the flexible or supple wall 40 and moves this downwards. The ring wall 41 formed at the inside of the wall 40 is also pressed downwards. This has the effect that the slanted lever 43 is pivoted downwards and that the sealing film 39 extending beneath it on the opening of the bottle neck is pretensioned. When the cap 1 is rotated further, the ring wall then presses with its downwardly directed teeth 42 on to the pretensioned sealing film 39 and pierces this and cuts it open along its periphery up to the region where the slanted pretensioning lever 43 is attached. Hence the sealing film 39 is neatly folded downwards into the bottle neck. The contents of the container capsule 8 fall into the bottle and the cap 1 can be removed from the bottle.

In FIG. 12 the state of the cap closure with both partially opened films 9, 39 can be seen. At the ring wall 41 one sees the upwardly directed teeth 12 as well as the downwardly directed teeth 42. Here the pretensioning lever 36 is half pivoted upwards and retains the film 9 already pivoted slightly upward, whilst on the other hand the pretensioning lever 43 retains the sealing film 39 pivoted somewhat downward. In the course of further rotation of the cap 1, the lever 36 pivots completely upwards and moves the film 9 completely up, and in the same manner the slanted lever 43 is pivoted completely downwards and thus moves the sealing film 39 completely downwards into the spout. Because the ring wall is retained at a supple wall 40, which, when the edge of the container capsule 8 is depressed, is inelastically flexed downwards and pressed, the ring wall 41 ultimately remains in this completely depressed position and, in this position, keeps the pretensioning lever 43 and the sealing film 39 completely pivoted downwards.

Therefore, this capsule closure can be configured in a number of combinations, for example for metered adding of a liquid to another liquid or to bulk goods, or reversely, for metered adding of free-flowing bulk goods into a liquid or bulk goods. The cap can be configured as a threaded cap having a left- or right-handed thread, or can be configured simply as a sliding cap, which can be sealed with an additional rubber sealing against the nipple part.

The invention claimed is:

1. A capsule closure for mounting over the spout opening or on the threaded connector end of a liquid or bulk goods container for metered adding of a substance by depressing or unscrewing the cap, wherein the cap (1) encloses a receptor device (2) formed at its lid inner side, which receptor device (2) fits into the interior of a coordinated nipple part (3), further that a coordinated film-sealed container capsule (8) having sealing film (9) is latchingly engaged in the interior of the receptor device (2) with its sealing film (9) facing the lower side of the cap (1), and that in the interior of the nipple part (3) below the inserted container capsule (8) there is an annular shoulder (10) which projects radially inwards, at the inner edge (11) of which there is mounted at least one fixed or movable piercing and/or cutting element (12), and on a shoulder (17) which projects radially outwards there is supported a tamper-evident strip (15) below the lower cap edge of the attached cap (1), after the removal of which the cap (1) is movable downwards on the nipple part (3), causing the fixed or movable piercing and/or cutting element (12) to become effective and to cut the film, and that the section (14) of the nipple part (3) that lies below the shoulder (10) is configured either as a sleeve or as a flange, and wherein at the inner edge of the inwardly projecting shoulder (12) there are formed upwardly directed piercing or cutting elements (12), and on a support element (37) there is attached a pretensioning lever (36), which is pivotable vertically about the support element (37), around a horizontally lying axis, so that by depressing its rear lever (38) the pretensioning lever (36) is pivotable upwards for pretensioning the film (9) in the container capsule.

2. The capsule closure for mounting over the spout opening or on the threaded connector end of a liquid or bulk goods container for metered adding of a substance by depressing or unscrewing the cap according to claim 1, wherein the container capsule comprises a double-side-effective piercing and cutting element (12, 42) for opening a double film seal, in that the inwardly projecting shoulder (10) evolves into a flexible or supple wall (40), which encloses a ring wall (41), which bears at its lower edge piercing and cutting members, and whereby at one part of the ring wall (41) there is formed a slanted pretensioning lever (43), which extends from the ring wall towards the centre of the threaded connector end, and having at the upper edge of the ring wall (41) upwardly directed piercing and cutting elements (12) as well as a pretensioning lever (36), so that when the capsule edge is depressed first its film (9) is pretensioned and can be cut open and pivoted upwards, and thereafter by depressing the flexible or supple wall (40) the slanted pretensioning lever (43) can be pressed on to a sealing film (39) on the spout opening and by means of the downwardly projecting piercing and cutting elements (42) at the ring wall (41) the lower sealing foil can be cut open and can be pivoted away by the pretensioning lever (43).

3. The capsule closure for mounting over the spout opening or on the threaded connector end of a liquid or bulk goods container for metered adding of a substance by depressing or unscrewing the cap according to claim 1, wherein the cap (1) is configured as a threaded cap (1) and encloses a receptor device (2) formed on its lid inner side, which receptor device fits into the interior of a coordinated nipple part (3), and the outer wall (4) of the threaded cap (1) comprises a thread (6) on its inner side, which fits on to the outer thread (7) of the nipple part (3), so that after removal of the tamper-evident strip (15) the threaded cap (1) can be screwed downwards at the nipple part (3) until the lower edge of the threaded cap (1) abuts at the outer shoulder (17) at the nipple part (3).

4. The capsule closure for mounting over the spout opening or on the threaded connector end of a liquid or bulk goods container for metered adding of a substance by depressing or unscrewing the cap according to of claim 1, wherein the cap (1) is configured as a sliding cap (1), and encloses a receptor device (2) formed at its lid inner side, which fits into the interior of a coordinated nipple part (3), and the outer wall (4) of the sliding cap (1) is sealingly slidable on to the outer wall of the nipple part (3), so that after removal of the tamper-evident strip (15) the sliding cap (1) is depressable downwards at the nipple part (3) until the lower edge of the sliding cap (1) abuts at the outer shoulder (17) at the nipple part (3).

5. The capsule closure for mounting over the spout opening or on the threaded connector end of a liquid or bulk goods container for metered adding of a substance by depressing or unscrewing the cap according to claim 1, wherein at the inner edge (11) of the radially inwardly projecting shoulder (10) in the interior of the nipple part (3) and distributed around its circumference there are formed both fixed piercing and/or cutting elements (12) having upwardly directed cutting edges (23) as well as piercing and/or cutting elements (30) being pivotable around the inner edge (11) of the shoulder (10) and having downwardly directed cutting teeth (31) or cutting edges.

6. The capsule closure for mounting over the spout opening or on the threaded connector end of a liquid or bulk goods container for metered adding of a substance by depressing or unscrewing the cap according to of claim 1, wherein at the inner edge (11) of the annular, radially inwardly projecting shoulder (10) and distributed around its circumference there are formed three fixed piercing and/or cutting elements (12) having upwardly directed cutting edges (23), and between each of these there is formed a piercing and/or cutting element (30) being downwardly pivotable around the inner edge (11) having downwardly projecting cutting edges.

7. The capsule closure for mounting over the spout opening or on the threaded connector end of a liquid or bulk goods container for metered adding of a substance by depressing or unscrewing the cap according to claim 1, wherein the cap (1) comprises at its top a pressure element (20) which is surrounded by at least one circumferential, deformable thin part (44) so that the pressure element (20) is movable axially to the cap (1) and can thus be pressed on to the container capsule (8) arranged below.

8. The capsule closure for mounting over the spout opening or on the threaded connector end of a liquid or bulk goods container for metered adding of a substance by depressing or unscrewing the cap according to claim 1, wherein the coordinated film-sealed container capsule (8), with respect to its outer shape forms a section of a cone having a cone-shaped upper side with an obtuse-angled tip, and that the underside comprises a radially outwardly projecting edge (22), which is untwistably latchingly engagable behind an inwardly projecting bead (21) arranged at the lower edge of the receptor device (2) and extending along a part or along the entire circumference.

9. The capsule closure for mounting over the spout opening or on the threaded connector end of a liquid or bulk goods container for metered adding of a substance by depressing or unscrewing the cap according to claim 1, wherein at the outer side of the nipple part (3) in axial extension of the downwardly projecting section (14) in an upward direction there is formed at the shoulder (17) a tamper-evident strip (15) by means of dedicated breaking points or a dedicated tearing seam, whose upper edge connects with the lower edge of the outer wall (4) of the cap (1), so that said cap (1) is movable downwards on the nipple part (3) only after removal of the tamper-evident strip (15).

* * * * *